US009747913B2

(12) United States Patent
Sung et al.

(10) Patent No.: US 9,747,913 B2
(45) Date of Patent: *Aug. 29, 2017

(54) APPARATUS AND METHOD DETERMINING WEIGHTING FUNCTION FOR LINEAR PREDICTION CODING COEFFICIENTS QUANTIZATION

(71) Applicant: SAMSUNG ELECTRONICS CO., LTD., Suwon-si (KR)

(72) Inventors: Ho Sang Sung, Yongin-si (KR); Eun Mi Oh, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/981,116

(22) Filed: Dec. 28, 2015

(65) Prior Publication Data

US 2016/0111106 A1 Apr. 21, 2016

Related U.S. Application Data

(63) Continuation of application No. 13/067,370, filed on May 26, 2011, now Pat. No. 9,236,059.

(30) Foreign Application Priority Data

May 27, 2010 (KR) ..... 10-2010-0049861

(51) Int. Cl.

| | |
|---|---|
| ***G10L 19/07*** | (2013.01) |
| ***G10L 19/06*** | (2013.01) |
| ***G10L 19/032*** | (2013.01) |

(52) U.S. Cl.
CPC ..... *G10L 19/06* (2013.01); *G10L 19/032* (2013.01); *G10L 19/07* (2013.01)

(58) Field of Classification Search
None
See application file for complete search history.

(56) References Cited

U.S. PATENT DOCUMENTS

| | | | |
|---|---|---|---|
| 5,754,974 | A | 5/1998 | Griffin et al. |
| 6,041,297 | A | 3/2000 | Goldberg et al. |
| 6,122,608 | A | 9/2000 | McCree |
| 6,131,083 | A | 10/2000 | Miseki et al. |

(Continued)

FOREIGN PATENT DOCUMENTS

KR 20030094538 A 12/2003

OTHER PUBLICATIONS

Das et al.; Variable-Dimension Vector Quantization of Speech Spectra fo Low-Rate Vocoders; Data compression Conference, 1994, DCC '94, Proceedings, Year: 1994; pp. 420-429.*

(Continued)

*Primary Examiner* — Abul Azad
(74) *Attorney, Agent, or Firm* — Sughrue Mion, PLLC

(57) ABSTRACT

An apparatus determining a weighting function for line prediction coding coefficients quantization converts a linear prediction coding (LPC) coefficient of an input signal into one of a line spectral frequency (LSF) coefficient and an immitance spectral frequency (ISF) coefficient and determines a weighting function associated with one of an importance of the ISF coefficient and importance of the LSF coefficient using one of the converted ISF coefficient and the converted LSF coefficient.

12 Claims, 8 Drawing Sheets

(56) References Cited

U.S. PATENT DOCUMENTS

| | | | |
|---|---|---|---|
| 6,311,159 | B1 | 10/2001 | Tichelen et al. |
| 6,377,914 | B1 | 4/2002 | Yeldener |
| 6,889,185 | B1 | 5/2005 | McCree |
| 2005/0065787 | A1 | 3/2005 | Stachurski |
| 2006/0271356 | A1 | 11/2006 | Vos |
| 2007/0136052 | A1 | 6/2007 | Gao et al. |
| 2008/0249767 | A1 | 10/2008 | Ertan |
| 2008/0249768 | A1 | 10/2008 | Ertan et al. |
| 2010/0023325 | A1 | 1/2010 | Bessette et al. |

OTHER PUBLICATIONS

"Coding of Speech At 16 kbit/s Using Low-Delay Code Excited Linear Prediction"—General Aspects of Digitaltransmission Systems; Terminal Equipments, The International Telegraph and Telephone Consultative Committee, International Telecommunication Union, Recommendation G.728 (Sep. 1992), Geneva, 1992, Total 65 pages.

Cohn et al.; Incorporating perception into LSD quantization some experiments; Acoustics, Speech and Signal Processing, 1997. ICASSP-97., 1997 IEEE International Conference on vol. 2, Publication Year 1997, pp. 1347-1350, vol. 2.

So, Stephen et al.; A comparison of LSF and ISP representations for wideband LPC parameter coding using the switched split vector quantiser; Signal Processing and its Applications, 2005, Proceedings of the Eighth International Symposium on Vol: 2; Publication Year: 2005; pp. 595-598.

Communication from Korean Intellectual Property Office issued Dec. 16, 2015 in counterpart Korean Patent Application No. 10-2010-0049861.

* cited by examiner

APPARATUS AND METHOD DETERMINING WEIGHTING FUNCTION FOR LINEAR PREDICTION CODING COEFFICIENTS QUANTIZATION

CROSS-REFERENCE TO RELATED APPLICATIONS

This application is a continuation of U.S. application Ser. No. 13/067,370 filed on May 26, 2011, which claims the priority benefit of Korean Patent Application No. 10-2010-0049861, filed on May 27, 2010, in the Korean Intellectual Property Office, the disclosures of which are incorporated herein by reference.

BACKGROUND

1. Field

Example embodiments relate to an apparatus and a method of determining a weighting function quantizing linear prediction coding (LPC) coefficients.

2. Description of the Related Art

Conventionally, linear prediction coding (LPC) is applied to coding speech signals and audio signals. Code-excited linear prediction (CELP) is used for LPC and uses an LPC coefficient and an excitation signal with respect to an input signal. When the input signal is coded, the LPC coefficient may be quantized. However, when the LPC coefficient is quantized as is, a resulting dynamic range is narrow and identification of stability is difficult.

When all LPC coefficients are quantized on the same importance in order to select a codebook index to reconstruct an input signal in a decoding process, quality of a finally synthesized input signal may deteriorate. Since all LPC coefficients have different weightings, the finally synthesized input signal is improved in quality when an important LPC coefficient has fewer errors. However, when a difference in weighting is not considered and the same weighting is applied in quantization, quality of the input signal deteriorates.

Thus, there is a demand for a method of efficiently quantizing an LPC coefficient and improving quality of a synthesized signal when the input signal is reconstructed by a decoding apparatus.

SUMMARY

The foregoing and/or other aspects are achieved by providing an apparatus determining a weighting function including a coefficient conversion unit to convert a linear prediction coding (LPC) coefficient of an input signal into one of a line spectral frequency (LSF) coefficient and an immitance spectral frequency (ISF) coefficient, a weighting function determination unit to determine a weighting function associated with a importance of the LPC coefficient where the weighting function is determined using one of the converted ISF coefficient and the converted LSF coefficient, and a quantization unit to quantize one of the converted ISF coefficient and the converted LSF coefficient using the determined weighting function, and to convert one of the quantized ISF coefficient and the quantized LSF coefficient into a quantized LPC coefficient.

The weighting function determination unit may determine, using a spectral magnitude of the input signal, a weighting function of each magnitude associated with a spectral envelope of the input signal.

The weighting function determination unit may determine the weighting function of each frequency using one of frequency information about the ISF coefficient and frequency information about the LSF coefficient, and combine the weighting function of each frequency with the weighting function of each magnitude.

The foregoing and/or other aspects are achieved by providing a method of determining a weighting function including converting, by at least one processor, a linear prediction coding (LPC) coefficient of an input signal into one of a line spectral frequency (LSF) coefficient and an immitance spectral frequency (ISF) coefficient, determining, by the at least one processor, a weighting function associated with an importance of the LPC coefficient using one of the converted ISF coefficient and the converted LSF coefficient, quantizing, by the at least one processor, using the determined weighting function one of the converted ISF coefficient and the converted LSF coefficient, and converting, by the at least one processor, into a quantized LPC coefficient one of the quantized ISF coefficient and the quantized LSF coefficient.

The determining of the weighting function may determine using a spectral magnitude of the input signal a weighting function of each magnitude associated with a spectral envelope of the input signal.

The determining of the weighting function may determine the weighting function of each frequency using frequency information about one of the ISF coefficient and frequency information about the LSF coefficient and combine the weighting function of each frequency with the weighting function of each magnitude.

The foregoing and/or other aspects are achieved by providing an apparatus and a method of determining a weighting function that converts and quantizes an LPC into one of an ISF coefficient and an LSF coefficient to improve quantization efficiency of the LPC coefficient.

The foregoing and/or other aspects are achieved by providing an apparatus and a method of determining a weighting function that determines a weighting function associated with an importance of an LPC coefficient to improve quality of a synthesized signal according to the importance of the LPC coefficient.

The foregoing and/or other aspects are achieved by providing an apparatus and a method of determining a weighting function that combines a weighting function of each magnitude and a weighting function of each frequency, the weighting function of each magnitude illustrating that one of an ISF and LSF actually influences a spectral envelope of an input signal and the weighting function of each frequency based on perceptual characteristics and a formant distribution in a frequency domain, to improve quantization efficiency of an LPC coefficient and to accurately calculate an importance of the LPC coefficient.

The foregoing and/or other aspects are achieved by providing a method including converting, by at least one processor, a linear prediction coding (LPC) coefficient of speech into one of a line spectral frequency coefficient (LSF) and an immitance spectral frequency coefficient (ISF), determining a weighted importance of the LPC coefficient by selecting and quantizing one of the LSF and ISF coefficients, where the weighted importance is based upon a frequency band of the speech, an encoding mode of the speech and spectrum analysis of the speech and converting the quantized selection into a quantized LPC coefficient.

According to another aspect of one or more embodiments, there is provided at least one non-transitory computer readable medium including computer readable instructions that control at least one processor to implement methods of one or more embodiments.

Additional aspects of embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
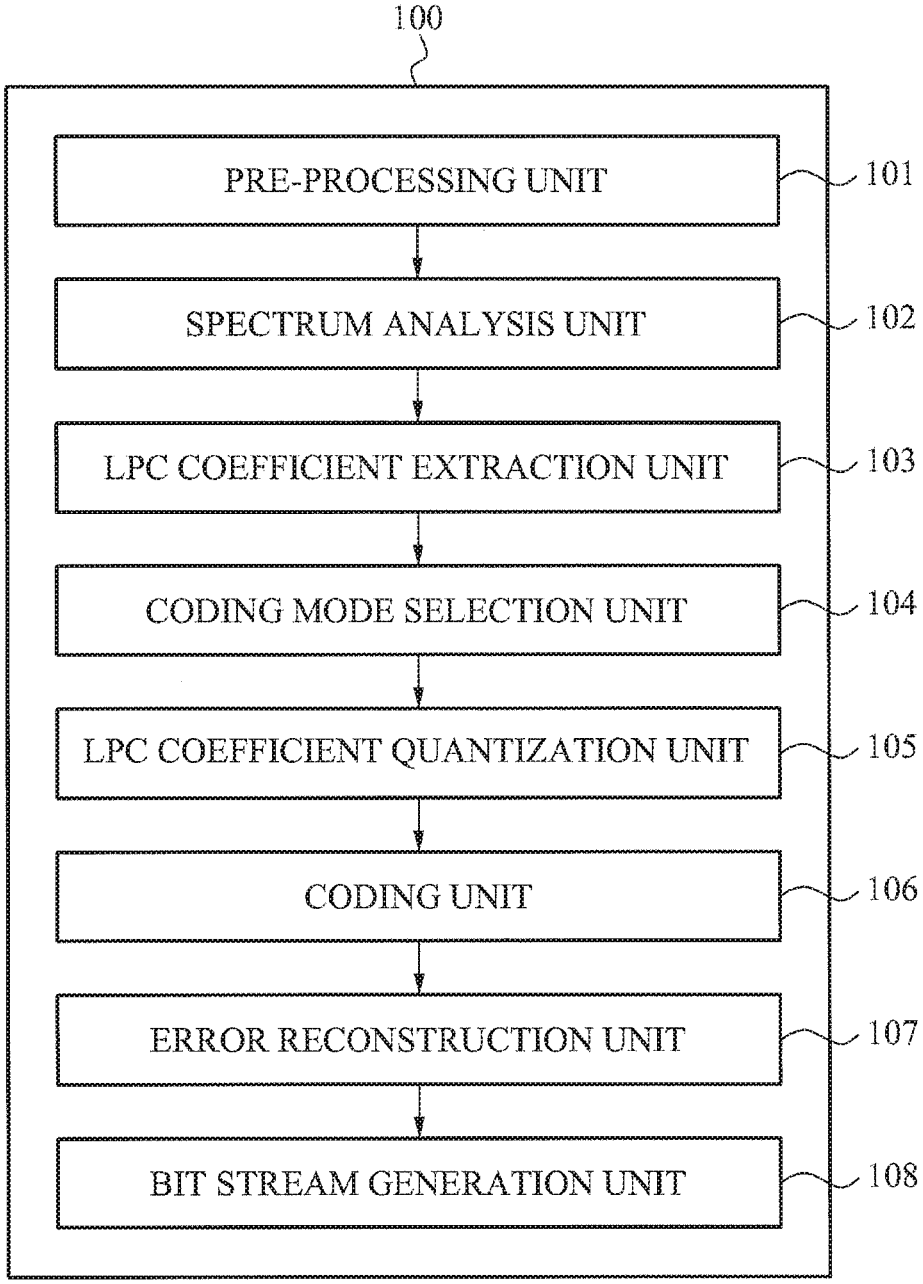
FIG. 1 illustrates an overall configuration of an audio signal coding apparatus according to example embodiments.

Reference will now be made in detail to embodiments, examples of which are illustrated in the accompanying drawings, wherein like reference numerals refer to like elements throughout. Embodiments are described below to explain the present disclosure by referring to the figures.

FIG. 1 illustrates an overall configuration of an audio signal coding apparatus according to example embodiments.

Referring to FIG. 1, the audio signal coding apparatus 100 may include a pre-processing unit 101, a spectrum analysis unit 102, a linear prediction coding (LPC) coefficient extraction unit 103, a coding mode selection unit 104, an LPC coefficient quantization unit 105, a coding unit 106, an error reconstruction unit 107, and a bit stream generation unit 108. The audio signal coding apparatus 100 may be applied to a speech signal.

The pre-processing unit 101 may pre-process an input signal to prepare the input signal for coding. The pre-processing unit 101 may pre-process the input signal through high pass filtering, pre-emphasis, and sampling conversion processes.

The spectrum analysis unit 102 may analyze characteristics of a frequency domain with respect to the input signal through a time-to-frequency process. The spectrum analysis unit 102 may determine whether the input signal is an active signal or a silence signal through a voice activity detection. Further, the spectrum analysis unit 102 may eliminate background noise from the input signal.

The LPC coefficient extraction unit 103 may extract an LPC coefficient through linear prediction analysis of the input signal. The LPC coefficient extraction unit 103 may analyze a pitch of the input signal through an open loop. Information about the analyzed pitch may be used to search for an adaptive codebook.

The coding mode selection unit 104 may select a coding mode of the input signal using the information about the pitch and information about the analysis of the frequency domain. For example, the input signal may be coded based on a coding mode which is one of a generic mode, a voiced mode, an unvoiced mode, and a transition mode.

The LPC coefficient quantization unit 105 may quantize the LPC coefficient extracted by the LPC coefficient extraction unit 103. The LPC coefficient quantization unit 105 will be further described with reference to FIGS. 2 to 5.

The coding unit 106 codes an excitation signal of the LPC coefficient based on a selected coding mode. Representative parameters to code the excitation signal of the LPC coefficient may be an adaptive codebook index, an adaptive codebook gain, a fixed codebook index, a fixed codebook gain, and the like. The coding unit 106 may code the excitation signal of the LPC coefficient in a sub-frame unit.

The error reconstruction unit 107 may reconstruct or conceal a frame to extract side information to improve overall sound quality when an error occurs in the frame of the input signal.

The bit stream generation unit 108 may generate the coded signal into a bit stream. The bit stream may be used for storage or transmission.

Figure 2:
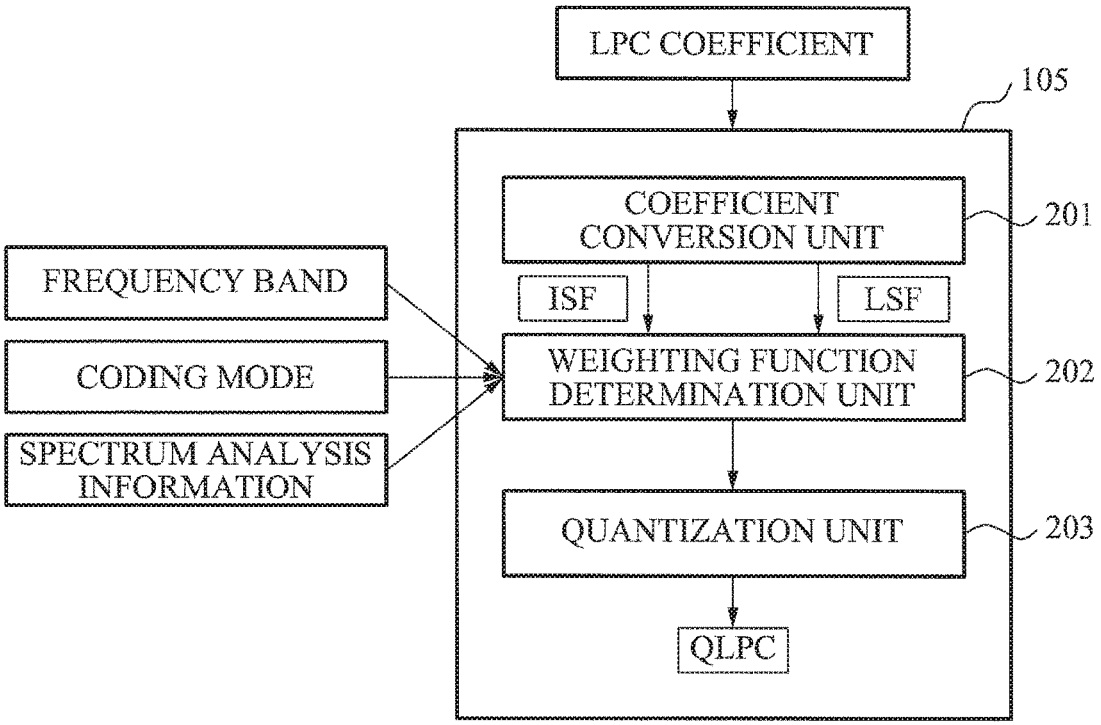
FIG. 2 illustrates a configuration of a linear prediction coding (LPC) coefficient quantization unit according to example embodiments.

FIG. 2 illustrates a configuration of the LPC coefficient quantization unit according to example embodiments.

Referring to FIG. 2, the LPC coefficient quantization unit 105 may include a coefficient conversion unit 201, a weighting function determination unit 202, and a quantization unit 203.

The coefficient conversion unit 201 may convert an LPC coefficient extracted through linear prediction analysis of an input signal. For example, the coefficient conversion unit 201 may convert the LPC coefficient into one format of a line spectral frequency (LSF) coefficient and an immitance spectral frequency (ISF) coefficient. The ISF coefficient and the LSF coefficient are formats to facilitate quantization of the LPC coefficient.

The weighting function determination unit 202 may determine a weighting function associated with an importance of the LPC coefficient using one of the converted ISF coefficient and the converted LSF coefficient. For example, the weighting function determination unit 202 may determine a weighting function of each magnitude and a weighting function of each frequency. Further, the weighting function determination unit 202 may determine a weighting function based on a frequency band, a coding mode, and spectrum analysis information.

For example, the weighting function determination unit 202 may extract an optimal weighting function in each coding mode. The weighting function determination unit 202 may extract an optimal weighting function based on a frequency band of the input signal. In addition, the weighting function determination unit 202 may extract an optimal weighting function based on information about frequency analysis of the input signal. The information about the frequency analysis may include spectrum tilt information.

Figure 4:
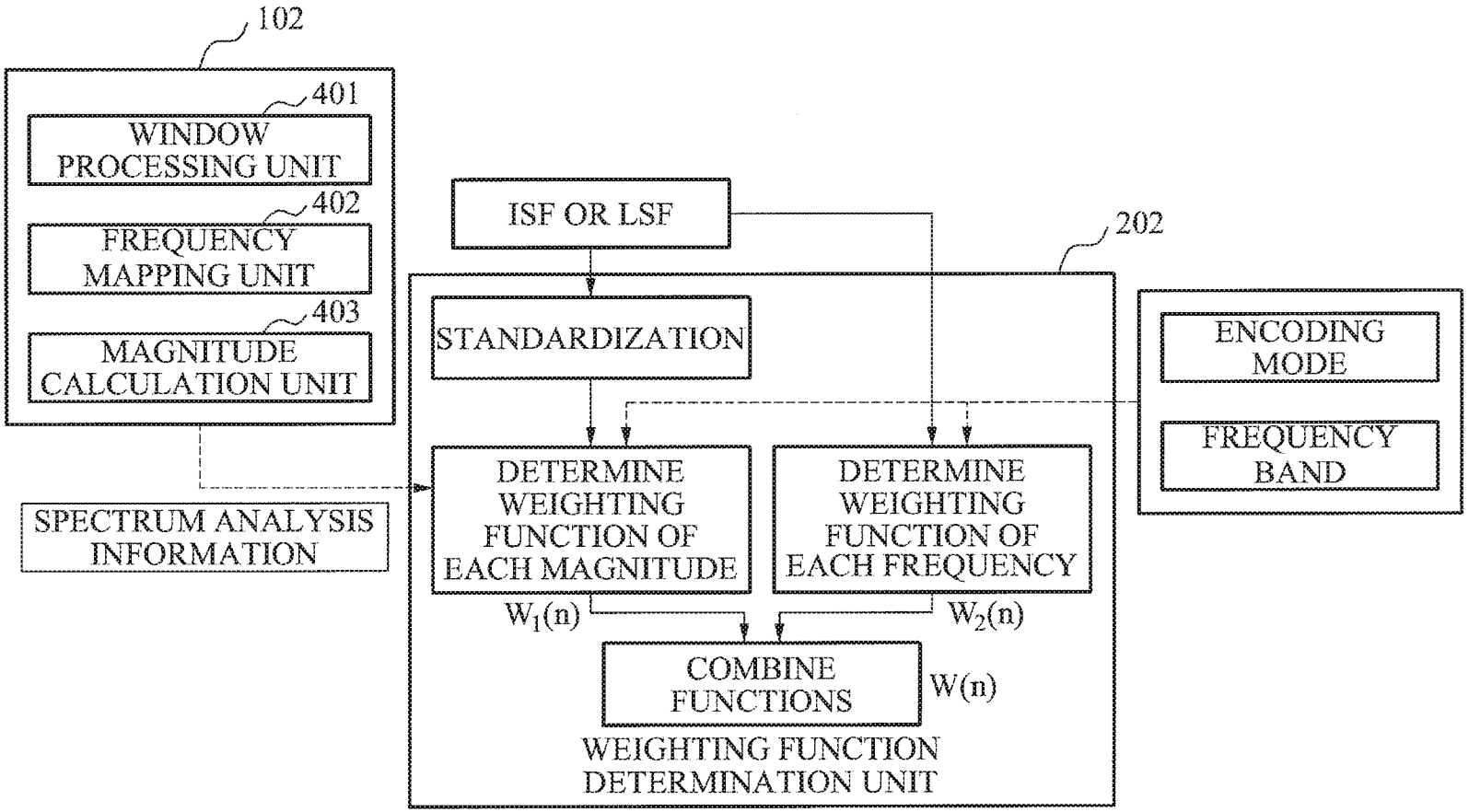
FIG. 4 illustrates a process of determining a weighting function according to example embodiments.
Figure 5:
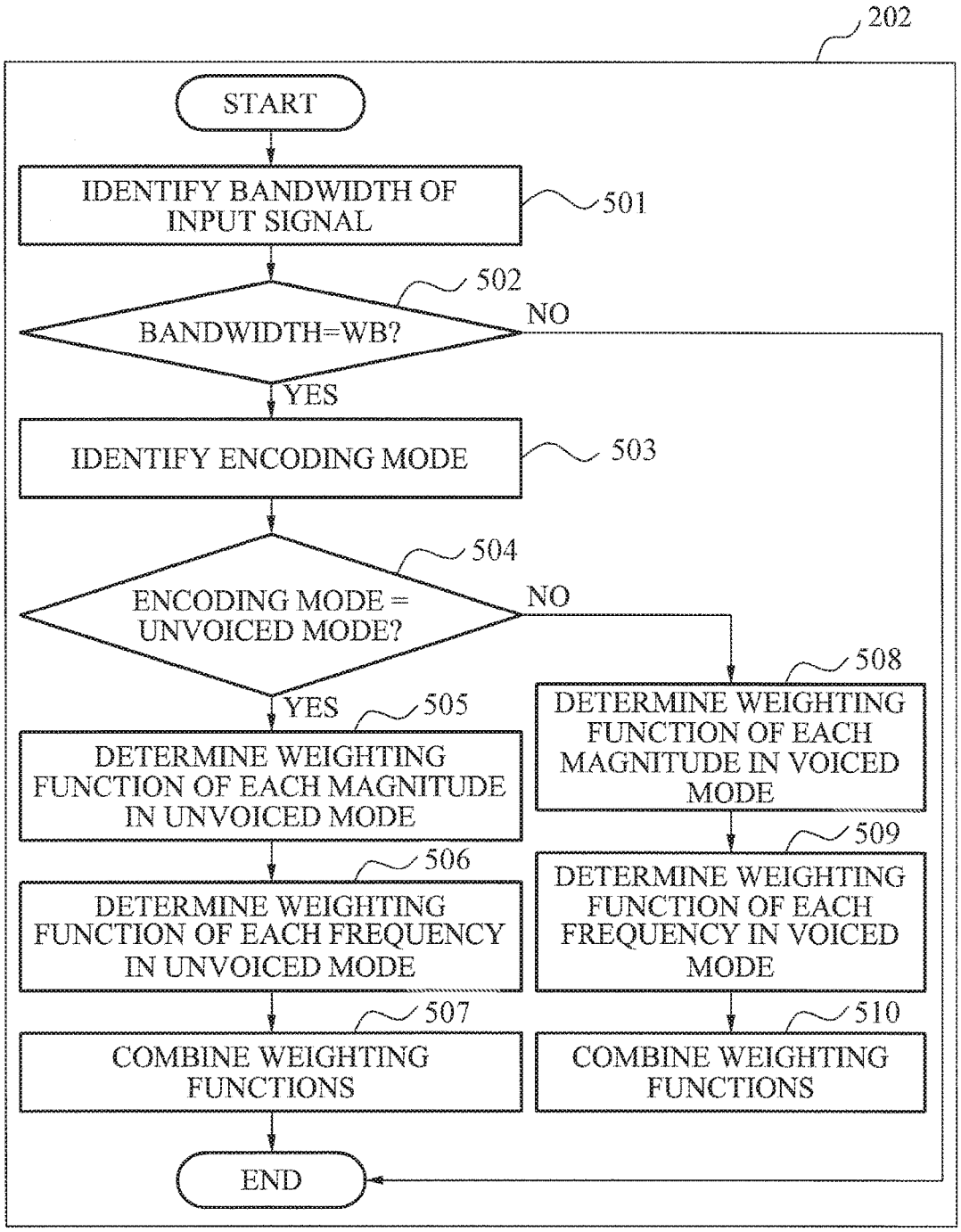
FIG. 5 illustrates a flowchart of a process of determining a weighting function using a coding mode and information about a bandwidth of an input signal according to example embodiments.

The weighting function determination unit 202 will be further described in operation with reference to FIGS. 4 and 5.

The quantization unit 203 may quantize one of the converted ISF coefficient and the converted LSF coefficient using the determined weighting function. The quantization unit 203 may convert one of the quantized ISF (QISF)

coefficient and the quantized LSF (QLSF) coefficient into a quantized LPC (QLPC) coefficient. The QLPC coefficient extracted by the quantization unit 203 may represent spectral information and represent a reflection coefficient, and a fixed weighting value may be used.

Hereinafter, relation between an LPC coefficient and a weighting function is further described.

LPC may be an available scheme to code a speech signal and an audio signal in a time domain. Linear prediction is short-term prediction. Linear prediction results represent a correlation between adjacent samples in a time domain and represent a spectral envelope in a frequency domain.

An applied coding scheme of linear prediction may include code excited linear prediction (CELP). Speech coding schemes using CELP may include G.729, AMR, AMR-WB, EVRC, and the like. In order to code a speech signal and an audio signal using CELP, an LPC coefficient and an excitation signal may be used.

An LPC coefficient may denote a correlation between adjacent samples and may be expressed by a spectral peak. When an LPC coefficient is a $16^{th}$ order, correlations between a maximum of sixteen samples may be extracted. An order of an LPC coefficient may be determined based on a bandwidth of an input signal and is generally determined based on characteristics of a speech signal. A main vocalization of the speech signal may be determined based on a magnitude and a position of a formant. In order to express a formant of the input signal, an LPC coefficient having a tenth order may be used for an input signal in a narrow band (NB) of 300 to 3400 Hz. An LPC coefficient having a $16^{th}$ to $20^{th}$ order may be used for an input signal in a wide band (WB) of 50 to 7000 Hz.

Figure 6:
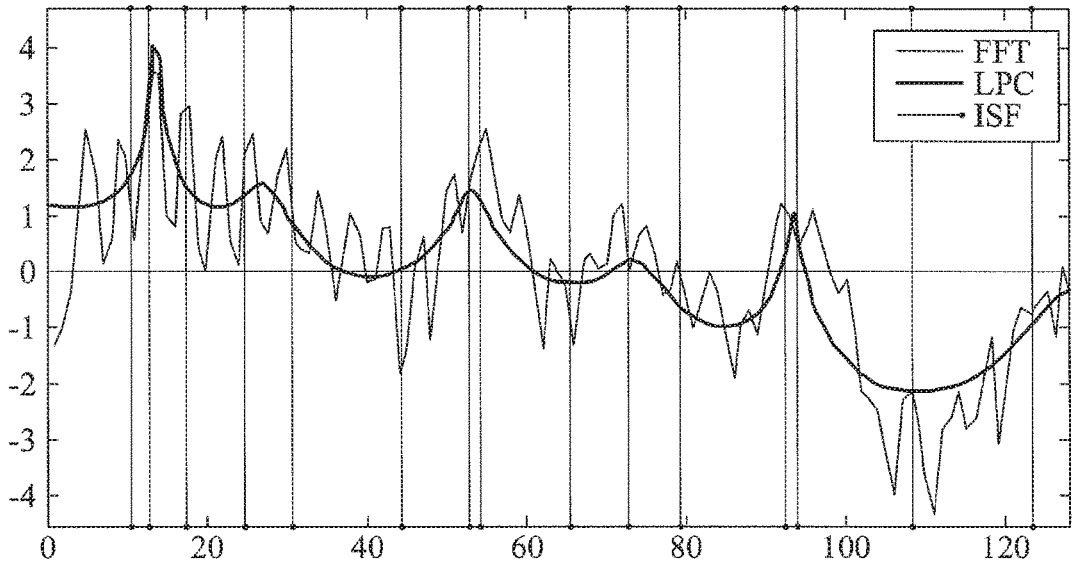
FIG. 6 illustrates a graph of an immitance spectral frequency (ISF) converted from an LPC coefficient according to example embodiments.

FIG. 6 illustrates a graph of a result of a spectrum when an input signal is converted into a frequency domain through a Fast Fourier Transform (FFT), an LPC coefficient extracted from the spectrum, and an ISF converted from the LPC coefficient. When the FFT is applied to the input signal in 256 samples, $16^{th}$-order linear prediction may be performed to generate 16 LPC coefficients, and the 16 LPC coefficients may be converted into 16 ISF coefficients.

The following Equation 1 represents a synthesis filter (H(z)), wherein $a_j$, denotes an LPC coefficient, and p denotes an order of the LPC coefficient.

$$H(z) = \frac{1}{A(z)} = \frac{1}{1 - \sum_{j=1}^{p} a_j z^{-j}},\ p = 10 \text{ or } 16 \sim 20 \qquad \text{[Equation 1]}$$

The following Equation 2 represents a synthesized signal by a decoder.

$$\hat{S}(n) = \hat{u}(n) - \sum_{i=1}^{p} \hat{a}_i \hat{s}(n-i),\ n = 0, \ldots, N-1 \qquad \text{[Equation 2]}$$

$\hat{S}(n)$ denotes a synthesized signal, and $\hat{u}(n)$ denotes an excitation signal. N denotes a magnitude of a coded frame using the same coefficient. The excitation signal may be determined by a sum of an adaptive codebook and a fixed codebook. A decoding apparatus may produce a synthesized signal using a decoded excitation signal and a quantized LPC coefficient.

An LPC coefficient may represent information about a formant of a spectrum represented by a spectral peak and be used to code an overall spectral envelope. The coding apparatus may convert the LPC coefficient into one of an ISF and LSF in order to enhance quantizing efficiency of the LPC coefficient.

The ISF may be prevented from diverging by quantization through simple stability identification. When there is a problem in stability, an interval of a quantized ISF may be adjusted to solve the problem in stability. The LSF may have the same characteristics as the ISF except that a final coefficient is a reflection coefficient. Since the ISF or LSF is converted from the LPC coefficient, the ISF or LSF may maintain the same information about the formant of the spectrum.

In detail, the LPC coefficient may be quantized after the LPC coefficient is converted into an immitance spectral pair (ISP), or into a line spectral pair (LSP) which has a narrow dynamic range, easily identified in stability, and favorable for interpolation. The ISP or LSP may be expressed by one of an ISF and LSF. The following Equation 3 represents a relation between an ISF and an ISP or a relation between an LSF and an LSP.

$$q_i = \cos(\omega_i) n = 0, \ldots, N-1 \qquad \text{[Equation 3]}$$

$q_i$ denotes an LSP or ISP, and $\omega_i$ denotes an LSF or ISF. Vector quantization may be performed on an LSF to improve quantization efficiency. Prediction vector quantization may be performed on an LSF to improve efficiency. In vector quantization, when a dimension is high, bit efficiency may be improved, however, a codebook may increase in magnitude and processing speed may decrease. Thus, multi-stage vector quantization or split vector quantization may be performed to decrease a magnitude of a codebook.

Vector quantization may refer to a process of selecting a codebook index having the fewest errors using a squared error distance measure based on all entries in a vector having the same weighting. However, in an LPC coefficient, all coefficients have different weightings, and thus an error may be reduced in an important coefficient to improve perceptual quality of a finally synthesized signal. Thus, when an LSF coefficient is quantized, the decoding apparatus may apply a weighting function representing an importance of each LPC coefficient to a squared error distance measure to select an optimal codebook index, and the synthesized signal may be improved in performance.

According to example embodiments, a weighting function of each magnitude regarding actual influence of each ISF or LSF actually on a spectral envelope may be determined using frequency information about ISF or frequency information about LSF and an actual spectral magnitude of ISF or LSF. Further, according to example embodiments, the weighting function of each magnitude may be combined with a weighting function of each frequency based on perceptual characteristics and a formant distribution of a frequency domain to obtain additional quantization efficiency. In addition, according to example embodiments, because a magnitude of an actual frequency domain is used, information about an envelope of an overall frequency is reflected sufficiently, and an importance of one of each ISF and each LSF may be calculated accurately.

In short, according to example embodiments, when vector quantization is performed on one of ISF and LSF converted from each LPC coefficient having a different importance, a weighting function representing which entry is relatively more important in a vector may be determined. A spectrum of a frame to be coded is analyzed to determine a weighting function to give a greater weighting to a high energy portion, and coding accuracy may be improved. High energy of a spectrum results in a high correlation in a time domain.

Figure 3A:
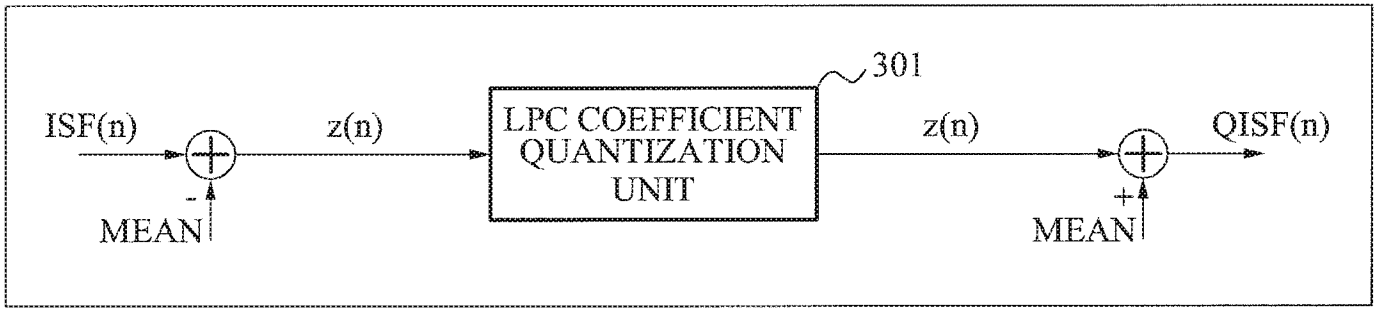
FIGS. 3A and 3B illustrate a process of quantizing an LPC coefficient according to example embodiments.
Figure 3B:
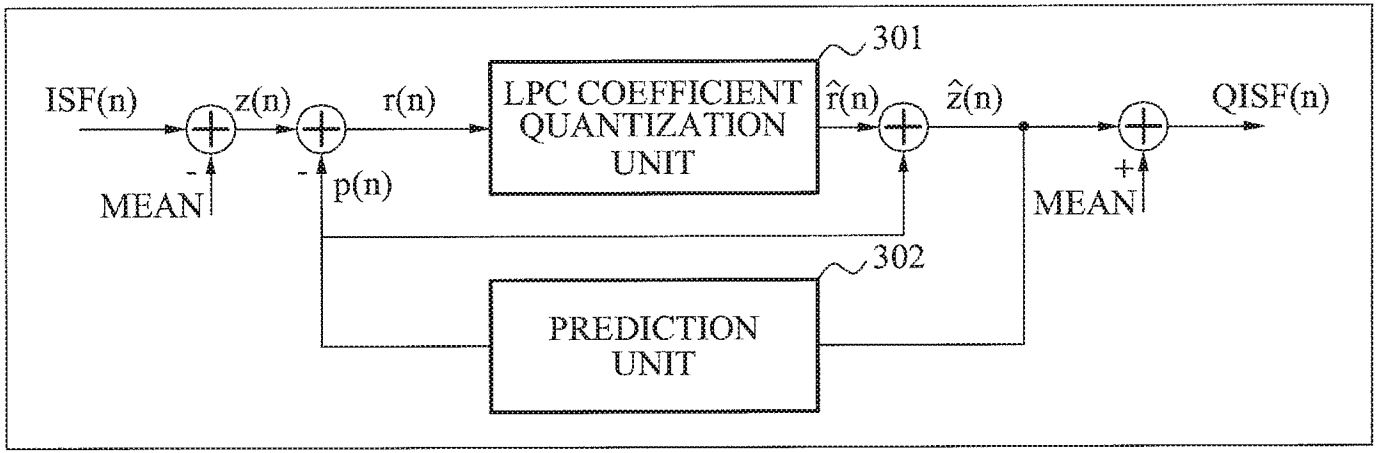

FIGS. 3A and 3B illustrate a process of quantizing an LPC coefficient according to example embodiments.

Referring to FIGS. 3A and 3B, two types of processes of quantizing an LPC coefficient are illustrated. FIG. 3A shows what is applied when input signal variability is substantial and FIG. 3B shows what is applied when input signal variability is small. FIGS. 3A and 3B may be applied differently depending on characteristics of an input signal.

An LPC coefficient quantization unit 301 may quantize an ISF through scalar quantization (SQ), vector quantization (VQ), split-vector quantization (SVQ), and multi-stage vector quantization (MSVQ). An LSF may be quantized in the same manner.

A prediction unit 302 may perform auto regressive (AR) prediction or moving average (MV) prediction. A prediction order may denote an integer number of 1 or more.

The following Equation 4 may represent an error function to search for a codebook index through the quantized ISF through the process illustrated in FIG. 3A. The following Equation 5 represents an error function to search for a codebook index through the quantized ISF through the process illustrated in FIG. 3B. A codebook index is a value to minimize the error functions.

$$E_{werr}(k) = \sum_{n=0}^{p} w(n)[z(n) - c_z^k(n)]^2 \quad \text{[Equation 4]}$$

$$E_{werr}(p) = \sum_{i=0}^{p} w(i)[r(i) - c_r^p(i)]^2 \quad \text{[Equation 5]}$$

w(n) denotes a weighting function, and z(n) is a vector obtained by eliminating a mean value from ISF(n) in FIGS. 3A and 3B. c(n) represents a codebook. p denotes an order of an ISF coefficient, and is generally 10 in the NB and is generally 16 to 20 in the WB.

According to example embodiments, the coding apparatus may determine an optimal weighting function by combining a weighting function of each magnitude and a weighting function of each frequency, the weighting function of each magnitude using a spectral magnitude corresponding to a frequency of one of an ISF coefficient and a frequency of an LSF coefficient converted from an LPC coefficient and the weighting function of each frequency based on perceptual characteristics and a formant distribution of an input signal.

FIG. 4 illustrates a process of determining a weighting function according to example embodiments.

FIG. 4 shows a detailed configuration of the spectrum analysis unit 102. The spectrum analysis unit 102 may include a window processing unit 401, a frequency mapping unit 402, and a magnitude calculation unit 403.

The window processing unit 401 may apply a window to an input signal. The window may use a rectangular window, a Hamming window, a sine window, and the like.

The frequency mapping unit 402 may map an input signal in a time domain to an input signal in a frequency domain. For example, the frequency mapping unit 402 may convert a frequency of the input signal through a FFT and a modified discrete cosine transform (MDCT).

The magnitude calculation unit 403 may calculate a magnitude of a frequency spectral bin with respect to the frequency converted input signal. A number of frequency spectral bins may be the same as a number of ISFs or LSFs to be normalized by the weighting function determination unit 202.

As a result of performance of the spectrum analysis unit 102, spectrum analysis information may be input to the weighting function determination unit 202. Here, the spectrum analysis information may include a spectrum tilt.

The weighting function determination unit 202 may normalize one of an ISF and LSF converted from an LPC coefficient. In the normalization, a final ISF coefficient is a reflection coefficient, and the same importance may be applied thereto. The above may not be applied to an LSF. The process is actually applied to a range of 0 to p-2 among $p^{th}$ order ISFs. 0 to $(p-2)_{th}$ order ISFs generally exist in 0 to π. The weighting function determination unit 202 may perform normalization of the same number K of ISFs or LSFs as the number of the frequency spectrum bins extracted by the frequency mapping unit 402 in order to use the spectrum analysis information.

The weighting function determination unit 202 may determine a weighting function of each magnitude $W_1(n)$ using the spectrum analysis information having one of an ISF coefficient and LSF coefficient which influences a spectral envelope. For example, the weighting function determination unit 202 may determine the weighting function of each magnitude using frequency information about one of the ISF coefficient and frequency information about the LSF coefficient and an actual spectral magnitude of an input signal. The weighting function of each magnitude may be determined for one of the ISF coefficient and the LSF coefficient converted from an LPC coefficient.

The weighting function determination unit 202 may determine the weighting function of each magnitude using a magnitude of a spectral bin corresponding to one of a frequency of the ISF coefficient and a frequency of the LSF coefficient.

Alternatively, the weighting function determination unit 202 may determine the weighting function of each magnitude using a magnitude of a spectral bin corresponding to one of a frequency of the ISF coefficient and a frequency of the LSF coefficient and a magnitude of at least one neighboring spectral bin disposed around the spectral bin. The weighting function determination unit 202 may determine the weighting function of each magnitude associated with a spectral envelope by extracting a representative value of the spectral bin and a representative value of the at least one neighboring spectral bin. Examples of the representative values may be a maximum value, an average value, or an intermediate value of the spectral bin corresponding to the frequency of the ISF coefficient or the frequency of the LSF coefficient and the at least one neighboring spectral bin around the spectral bin.

For example, the weighting function determination unit 202 may determine a weighting function of each frequency $W_2(n)$ using one of frequency information about the ISF coefficient and frequency information about the LSF coefficient. In detail, the weighting function determination unit 202 may determine the weighting function of each frequency using perceptual characteristics and a formant distribution of the input signal. The weighting function determination unit 202 may extract the perceptual characteristics of the input signal based on a bark scale. The weighting function determination unit 202 may determine the weighting function of each frequency based on a first formant of the formant distribution.

For example, in the weighting function of each frequency, a relatively low weighting may be represented in an extremely low frequency or a high frequency, and a weighting having the same magnitude may be represented within a predetermined range of a low frequency corresponding to a first formant.

The weighting function determination unit 202 may determine a final weighting function by combining the weighting function of each magnitude and the weighting function of each frequency. The weighting function determination unit 202 may determine the final weighting function by multiplying or adding the weighting function of each magnitude and the weighting function of each frequency.

Alternatively, the weighting function determination unit 202 may determine the weighting function of each magnitude and the weighting function of each frequency based on a coding mode and frequency band information of the input signal, which will be further described with reference to FIG. 5.

FIG. 5 illustrates a flowchart of a process of determining a weighting function using an encoding mode and information about bandwidth of an input signal according to example embodiments.

The weighting function determination unit 202 may identify bandwidth of an input signal in operation 501. The weighting function determination unit 202 may determine whether the bandwidth of the input signal is WB in operation 502. When the bandwidth of the input signal is not WB, the process of determining a weighting function is not performed.

When the bandwidth of the input signal is WB, the weighting function determination unit 202 may identify an encoding mode of the input signal in operation 503. The weighting function determination unit 202 may determine whether the encoding mode of the input signal is an unvoiced mode in operation 504. When the encoding mode of the input signal is the unvoiced mode, the weighting function determination unit 202 may determine a weighting function of each magnitude in the unvoiced mode in operation 505, determine a weighting function of each frequency in the unvoiced mode in operation 506, and combine the weighting function of each magnitude and the weighting function of each frequency in operation 507.

However, when the encoding mode of the input signal is different from the unvoiced mode in operation 504, the weighting function determination unit 202 may determine a weighting function of each magnitude in a voiced mode in operation 508, determine a weighting function of each frequency in the voiced mode in operation 509, and combine the weighting function of each magnitude and the weighting function of each frequency in operation 510. When the encoding mode of the input signal is one of a generic mode and a transition mode, the weighting function determination unit 202 may determine a weighting function according to the voiced mode.

For example, when a frequency of the input signal is converted by FFT, a weighting function of each magnitude using a spectral magnitude of an FFT coefficient may be determined by Equation 6.

$$W_1(n)=(3\cdot\sqrt{w_f(n)-\mathrm{Min}})+2,\ \mathrm{Min}=\text{Minimum value of } w_f(n) \qquad \text{[Equation 6]}$$

Where, $w_f(n)=10\ \log(\max(E_{bin}(\mathrm{norm_isf}(n)),\ E_{bin}(\mathrm{norm_isf}(n)+1),\ E_{bin}(\mathrm{norm_isf}(n)-1))),$ for, $n=0, \ldots, M-2$, $1\le \mathrm{norm_isf}(n)\le 126$ $w_f(n)=10\ \log(E_{bin}(\mathrm{norm_isf}(n)))$, for, $\mathrm{norm_isf}(n)=0$ or $127$ $\mathrm{norm_isf}(n)=\mathrm{isf}(n)/50$, then, $0\le \mathrm{isf}(n)\le 6350$, and $0\le \mathrm{norm_isf}(n)\le 127$ $$E_{BIN}(k)=X_R^2(k)+X_I^2(k),\ k=0, \ldots, 127$$

Figure 7:
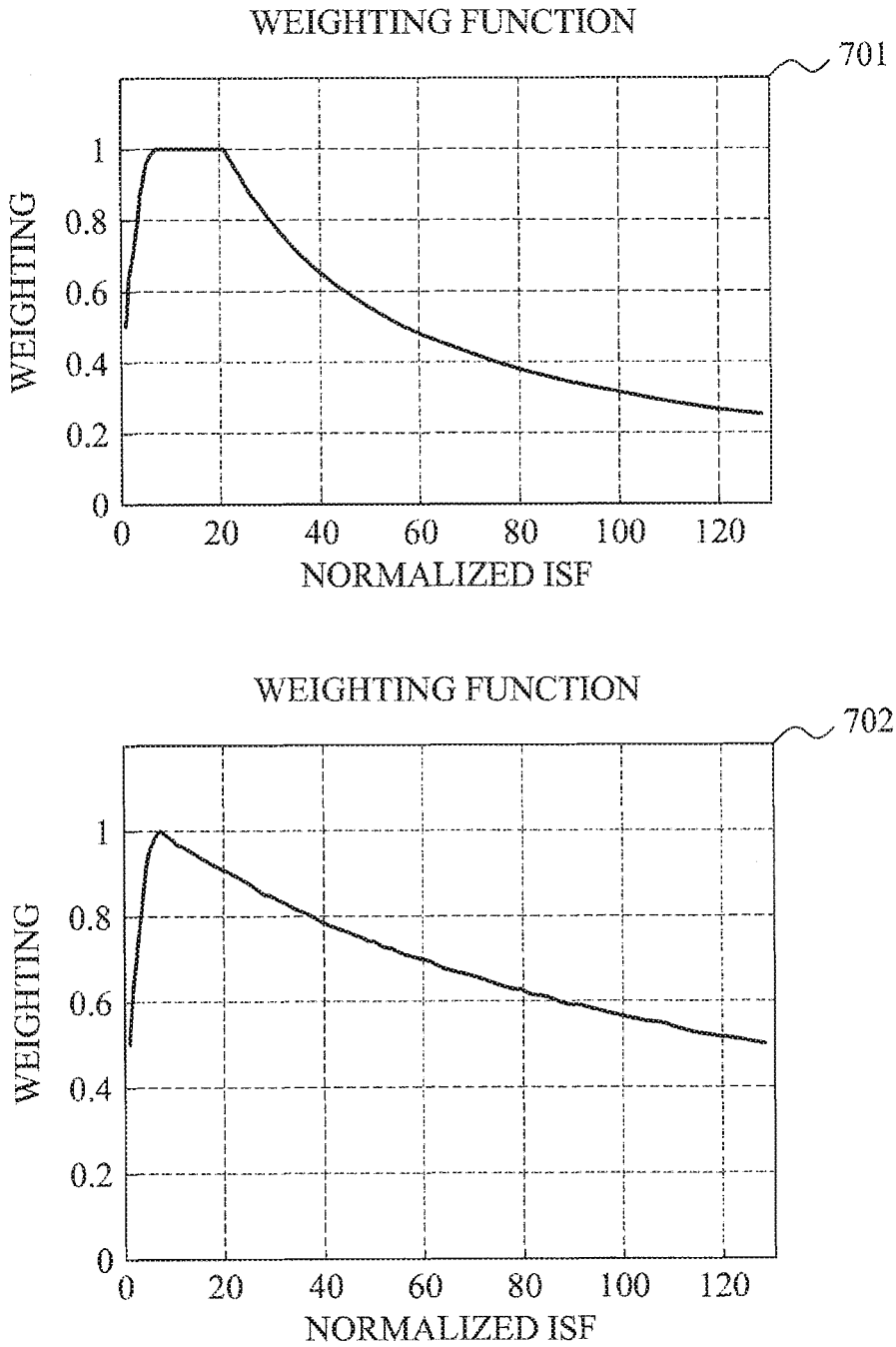
FIG. 7 illustrates a graph of a weighting function according to a coding mode according to example embodiments.

The weighting function of each frequency determined based on the encoding mode is shown in FIG. 7. FIG. 7 illustrates a graph of a weighting function according to an encoding mode according to example embodiments. A graph 701 illustrates the weighting function of each frequency in the voiced mode. A graph 702 illustrates the weighting function of each frequency in the unvoiced mode.

For example, the graph 701 may be determined by Equation 7, and the graph 702 may be determined by Equation 8. Constants in Equations 7 and 8 may be changed depending on characteristics of the input signal.

$$W_2(n)=0.5+\frac{\sin\left(\frac{\pi\cdot \mathrm{norm_isf}(n)}{12}\right)}{2},\ \text{For, } \mathrm{norm_isf}(n)=[0,5] \qquad \text{[Equation 7]}$$

$$W_2(n)=1.0\ \text{For, } \mathrm{norm_isf}(n)=[6,20]$$

$$W_2(n)=\frac{1}{\left(\frac{4*(\mathrm{norm_isf}(n)-20)}{107}+1\right)},\ \text{For, } \mathrm{norm_isf}(n)=[21,127]$$

$$W_2(n)=0.5+\frac{\sin\left(\frac{\pi\cdot \mathrm{norm_isf}(n)}{12}\right)}{2},\ \text{For, } \mathrm{norm_isf}(n)=[0,5] \qquad \text{[Equation 8]}$$

$$W_2(n)=\frac{1}{\left(\frac{(\mathrm{norm_isf}(n)-6)}{121}+1\right)},\ \text{For, } \mathrm{norm_isf}(n)=[6,127]$$

A final weighting function may be determined by Equation 9.

$$W(n)=W_1(n)\cdot W_2(n),\ \text{for } n=0, \ldots, M-2$$

$$W(M-1)=1.0 \qquad \text{[Equation 9]}$$

The method of determining the weighting function according to the above-described embodiments may be recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may be a plurality of computer-readable storage devices in a distributed network, so that the program instructions are stored in the plurality of computer-readable storage devices and executed in a distributed fashion. The program instructions may be executed by one or more processors or processing devices. The computer-readable media may also be embodied in at least one application specific integrated circuit (ASIC) or Field Programmable Gate Array (FPGA). Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa.

Although embodiments have been shown and described, it should be appreciated by those skilled in the art that changes may be made in these embodiments without departing from the principles and spirit of the disclosure, the scope of which is defined by the claims and their equivalents.

What is claimed is:

1. An apparatus for quantizing an input signal, the apparatus comprising:

a coefficient conversion unit, implemented by a processor, configured to obtain a line spectral frequency (LSF) coefficient from a linear predictive coding (LPC) coefficient of the input signal;

a normalization unit configured to normalize the LSF coefficient to a range of spectral bins obtained by time-to-frequency mapping of the input signal;

a weighting function determination unit, configured to determine a first weighting function based on a magnitude of a spectral bin corresponding to a frequency of the normalized LSF coefficient, determine a second weighting function based on frequency information from the normalized LSF coefficient, and determine a combined weighting function by using the first weighting function and the second weighting function; and a quantization unit configured to quantize the LSF coefficient based on the combined weighting function, wherein the first weighting function is based on a maximum value of the magnitude of the spectral bin corresponding to the frequency of the normalized LSF coefficient and the magnitude of at least one neighboring spectral bin, wherein the frequency information is based on at least one of perceptual characteristics and a formant distribution of the input signal, and wherein the input signal has at least one of audio characteristics and speech characteristics.

2. The apparatus of claim 1, wherein the first weighting function is based on a spectral envelope of the input signal.

3. The apparatus of claim 1, wherein the first weighting function is varied depending on at least one of a bandwidth and a coding mode of the input signal.

4. The apparatus of claim 1, wherein the perceptual characteristics are based on a bark scale.

5. The apparatus of claim 1, wherein the frequency information is further based on a coding mode of the input signal.

6. The apparatus of claim 1, wherein the frequency information is further based on a bandwidth of the input signal.

7. A method of quantizing an input signal, the method comprising:

obtaining a line spectral frequency (LSF) coefficient from a linear predictive coding (LPC) coefficient of the input signal;

normalizing the LSF coefficient to a range of spectral bins obtained by time-to-frequency mapping of the input signal;

determining, performed by a processor, a first weighting function based on a magnitude of a spectral bin corresponding to a frequency of the LSF coefficient;

determining a second weighting function based on frequency information from the normalized LSF coefficient;

determining a combined weighting function by using the first weighting function and the second weighting function;

quantizing the LSF coefficient based on the combined weighting function, wherein the weighting function is based on a maximum value of the magnitude of the spectral bin corresponding to the frequency of the normalized LSF coefficient and the magnitude of at least one neighboring spectral bin, wherein the frequency information is based on at least one of perceptual characteristics and a formant distribution of the input signal, and wherein the input signal has at least one of audio characteristics and speech characteristics.

8. The method of claim 7, wherein the first weighting function is based on a spectral envelope of the input signal.

9. The method of claim 7, wherein the first weighting function is varied depending on at least one of a bandwidth and a coding mode of the input signal.

10. The method of claim 7, wherein the perceptual characteristics are based on a bark scale.

11. The method of claim 7, wherein the frequency information is further based on a coding mode of the input signal.

12. The method of claim 7, wherein the frequency information is further based on a bandwidth of the input signal.

* * * * *